US005353966A

United States Patent [19]

Stutz et al.

[11] Patent Number: 5,353,966

[45] Date of Patent: Oct. 11, 1994

[54] APPARATUS FOR DISCHARGING DOSED QUANTITIES OF A BULK MATERIAL

[75] Inventors: Edwin Stutz, Reinach; Jean Cuennet, Düdingen, both of Switzerland

[73] Assignee: Anag A. Nussbaumer AG., Düdingen, Switzerland

[21] Appl. No.: 710,369

[22] Filed: May 31, 1991

[30] Foreign Application Priority Data

Jun. 1, 1990 [CH] Switzerland ..... 1873/90

[51] Int. Cl.[5] ..... B65D 83/00

[52] U.S. Cl. ..... 222/145; 222/202; 222/203

[58] Field of Search ..... 222/196, 202, 203, 198, 222/145, 185, 201

[56] References Cited

U.S. PATENT DOCUMENTS

| | | | |
|---|---|---|---|
| 1,987,289 | 1/1935 | Gardner et al. | 222/145 |
| 2,381,802 | 8/1945 | Booth et al. | 222/200 |
| 2,560,480 | 7/1951 | Rogers et al. | 222/200 |
| 2,646,905 | 7/1953 | Vincent | 222/203 X |
| 2,756,906 | 7/1956 | Carter | 222/203 |
| 3,099,494 | 7/1963 | Heinze | 222/202 X |
| 3,346,917 | 10/1967 | Lennox | 222/203 X |
| 3,773,221 | 11/1973 | Lesk et al. | 222/56 |
| 4,373,645 | 2/1983 | Boyd | 222/203 |
| 4,383,766 | 5/1983 | Eriksson | 222/203 X |
| 4,423,832 | 1/1984 | Boyd et al. | 222/203 |

FOREIGN PATENT DOCUMENTS

| | | | |
|---|---|---|---|
| 1196329 | 7/1965 | Fed. Rep. of Germany | 222/203 |
| 6512219 | 11/1966 | Netherlands | 222/196 |
| 449246 | 11/1974 | U.S.S.R. | 222/203 |
| 552250 | 4/1977 | U.S.S.R. | 222/196 |
| 2084117 | 4/1982 | United Kingdom | 222/196 |

*Primary Examiner*—Andres Kashnikow
*Assistant Examiner*—Anthoula Pomrening
*Attorney, Agent, or Firm*—Michael J. Striker

[57] ABSTRACT

An apparatus for discharging dosed quantities of a bulk material from a bin having a discharge end, includes a material loosening unit adapted to extend below the discharge end, a foil unit covering the material loosening unit and extending so as to form a conical surface for contacting directly the bulk material filled in the bin, so that the loosening unit contacts the bulk material indirectly through the foil unit, and a shutter unit associated with the foil unit opposite to the discharge end and movable between an open position and a closed position.

20 Claims, 6 Drawing Sheets

APPARATUS FOR DISCHARGING DOSED QUANTITIES OF A BULK MATERIAL

BACKGROUND OF THE INVENTION

The invention relates to an apparatus for discharging dosed quantities of a bulk material from a storage bin, with a funnel provided at the bottom portion of the storage bin, at least one material loosening unit arranged on the funnel, and a shutter unit for opening and closing the orifice of a discharge hole arranged at the lower funnel end.

Known discharging apparatuses of the kind are designed to provide a safe, uniform discharge of the bulk material by a stripping unit which forms a loosening devices. The stripping unit, in the region of its outer end, is bent backward in opposite direction to the direction of its rotation. A screw conveyor is located in a hollow cylindrical discharge hole and acts in downward direction onto the bulk material. In the case of a tapering orifice, even in combination with an additional stripping unit the conveyor is bent in opposite direction to the direction of its rotation. Thereby, the rotating stripping unit is in permanent contact with the bulk material to be discharged, so that the grains are subjected to erosion, mutilation or even destruction. This situation prevents the use of known discharging apparatuses for the handling of delicate bulk material in many cases.

SUMMARY OF THE INVENTION

Accordingly, it is an object of the present invention to create an apparatus of the kind described, which also enables the handling of delicate substances of a granular character particularly subjected to erosion and without producing any harmful effect on these.

This object is attained by providing a funnel-shaped foil which covers the loosening unit, and in particular a stripping unit.

The stripping unit rotating between funnel wall and foil effects a motion of the latter, which, in its turn, brings about a spiral whirl in the bulk material to be discharged. Thereby, the stripping unit does not come into contact with the material itself. The loosening of the product is done in a gentle way by the foil biased by the stripping unit. Thus, any erosion, mutilation and destruction of the granular bulk material will be prevented. The agglutination of the latter and, therefore, the development of archings of bulk material inside the funnel is, therefore, no longer possible. The funnel-shaped foil ensures an undisturbed passage of the material, since there are no mechanical parts in its interior and it is well possible to provide the foil with particularly good gliding characteristics.

A contamination by various polluting substances, such as gear lubricant oil, etc., will also be prevented by the foil.

The foil is a cheap wearing article replaceable without any expert knowledge. The chemical characteristics of the plastic of which the foil is made will be determined by the respective purpose.

Since any erosion of material will be minimized by utilizing the foil, the discharging apparatus provided by the invention may also be employed for the handling of bulk material complying with the highest requirements, such as pharmaceutics (antibiotics, blood plasma, etc.), or raw materials of the extremely pure technologies, such as heavy and rare metals for the powder metallurgy, metallic oxides for the fields of piezoelectrics, fiber optics, metal chlorides for the nuclear industry, etc. The foil can consist of some plastic material and be composed of several layers. The foil can be manufactured from a composite material consisting of a natural substance and some plastic material. The foil can have a property characterized by being permeable to gas. The loosening unit and the foil may be surrounded by a rigidly mounted outer funnel, and/or by a plurality of struts arranged between the periphery of the opening in the bottom portion of the storage bin and a gear casing comprising the hollow cylindrical discharge hole outside the imaginary conical surface formed by the path of movement of the stripping unit. The funnel-shaped foil can be designed in the form of flake-shaped strips of textile fabric and/or plastic material, with said strips overlapping each other along their edges extending in the direction of the generatrices of the surface of the funnel and with the overlapping being oriented in each case in the direction of rotation of the stripping unit forming the loosening unit. The overlapping edges may be reinforced each by a reinforcing beam. The loosening unit can be formed by pads or hoses which can be inflated by means of compressed-air impulses in a revolving succession, or by a hose, which can be biased by pressure, and wound in a helicoid manner around the funnel-shaped foil.

Furthermore, the invention also relates to the use of the above-mentioned apparatuses for simultaneously discharging bulk material from several storage bins to a mixing arrangement for the formation of a compound material made of granular components. Thereby, the rigidly fixed outer funnel does not overlap the lower portion of the funnel-shaped foil of each respective discharging apparatus. The tapered foil is connected to each appertaining orifice shaped like a hollow cylinder. The funnel forms an oblique cone having a middle axis which leads to the mixing apparatus, so that the middle axes of all the oblique cones intersect at the inlet of the mixing apparatus. Further, each foil portion shaped like an oblique cone may be assigned a stripping unit rotating on a circular path and acting on the foil merely along a certain portion of its orbit.

BRIEF DESCRIPTION OF THE DRAWINGS

In the following, the invention will be explained by means of some preferred embodiments provided by the invention according to the drawings:

FIGS. 4 and 4*a*—plan views of still further embodiments of the subject matter of the invention in cross-sectional view;

FIG. 4*b*—a plan view of the embodiment according to FIG. 4*a;*

DESCRIPTION OF PREFERRED EMBODIMENTS

Figure 1:
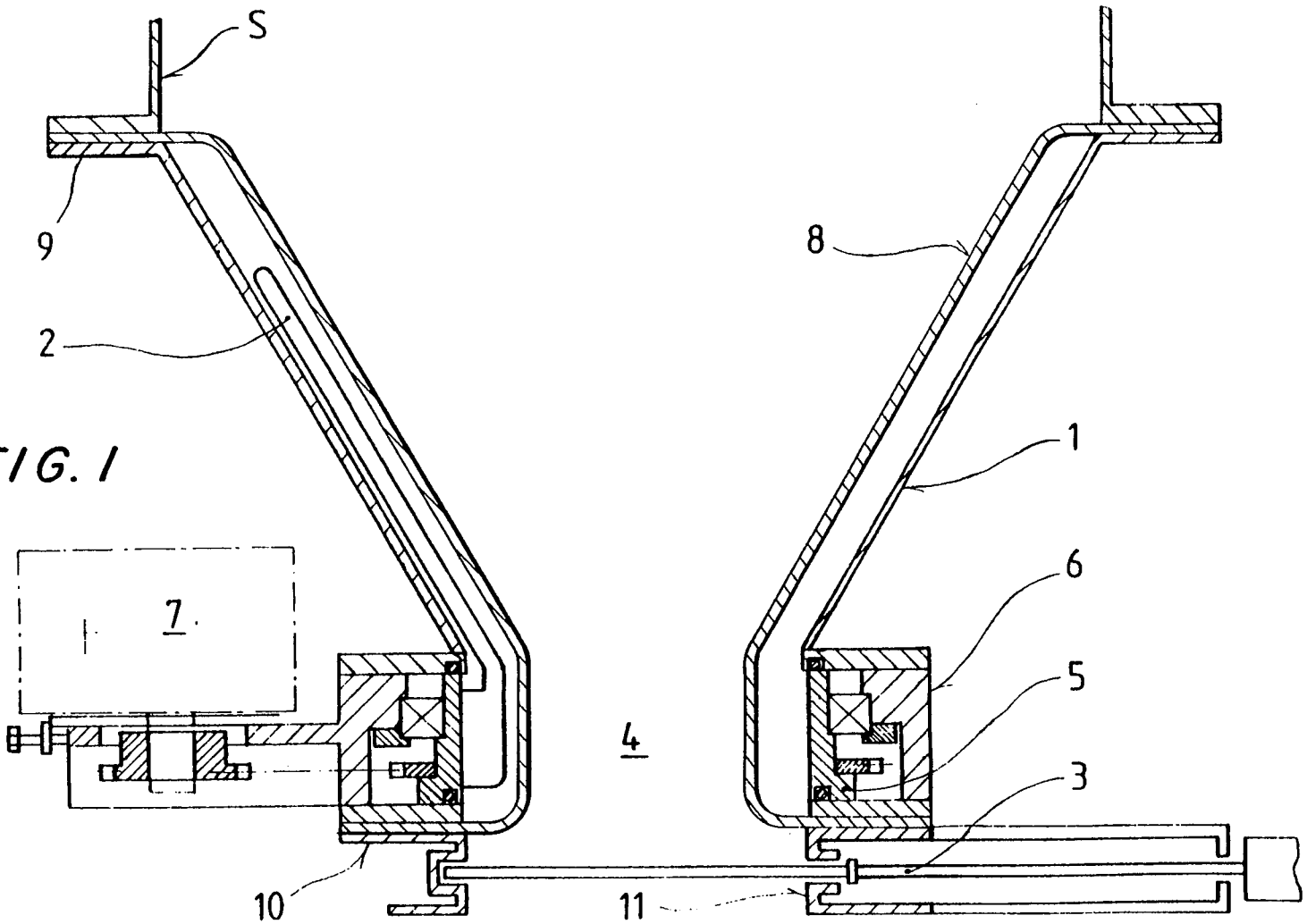
FIG. 1—a front-elevation drawing of an apparatus provided by the invention for discharging dosed quantities of a bulk material from a bin in cross-sectional view.

An apparatus according to the invention is used for the discharge of bulk material from a container. The apparatus has for example a storage bin S, a funnel 1 arranged so as to join an opening in the bottom portion of the bin, at least one stripping unit 2 rotating in the interior of the bin along its inside surface, and a shutter unit 3 for opening, regulating, and closing the orifice of a discharge hole 4 formed as a hollow cylinder connected to the lower end of a tapered funnel. The stripping unit 2 is fixed to an annular body which is rotatably mounted in a gear casing 6 and driven by an electromotor 7.

A foil 8 is arranged outside the stripping unit 2. The foil 8 is shaped and clamped at its inlet between the edge of the opening located in the bottom portion of the storage bin and the flange 9 of the funnel inlet of relatively large cross section. The flange is connected to the bin. The foil is also clamped at its outlet, between the edge of the orifice of the hollow cylindrical discharge hole 4 and a flange 10.

The foil 8 is manufactured from plastic material and can have several layers. According to the intended use, the foil 8 may be made of a composite material of a natural substance and a plastic material, and it may be permeable to gas.

In another embodiment of the apparatus provided by the invention, the funnel-shaped foil 8, at its outlet, may be designed so as to extend into the hollow cylindrical discharge hole 4 just for a short stretch.

Figure 2:
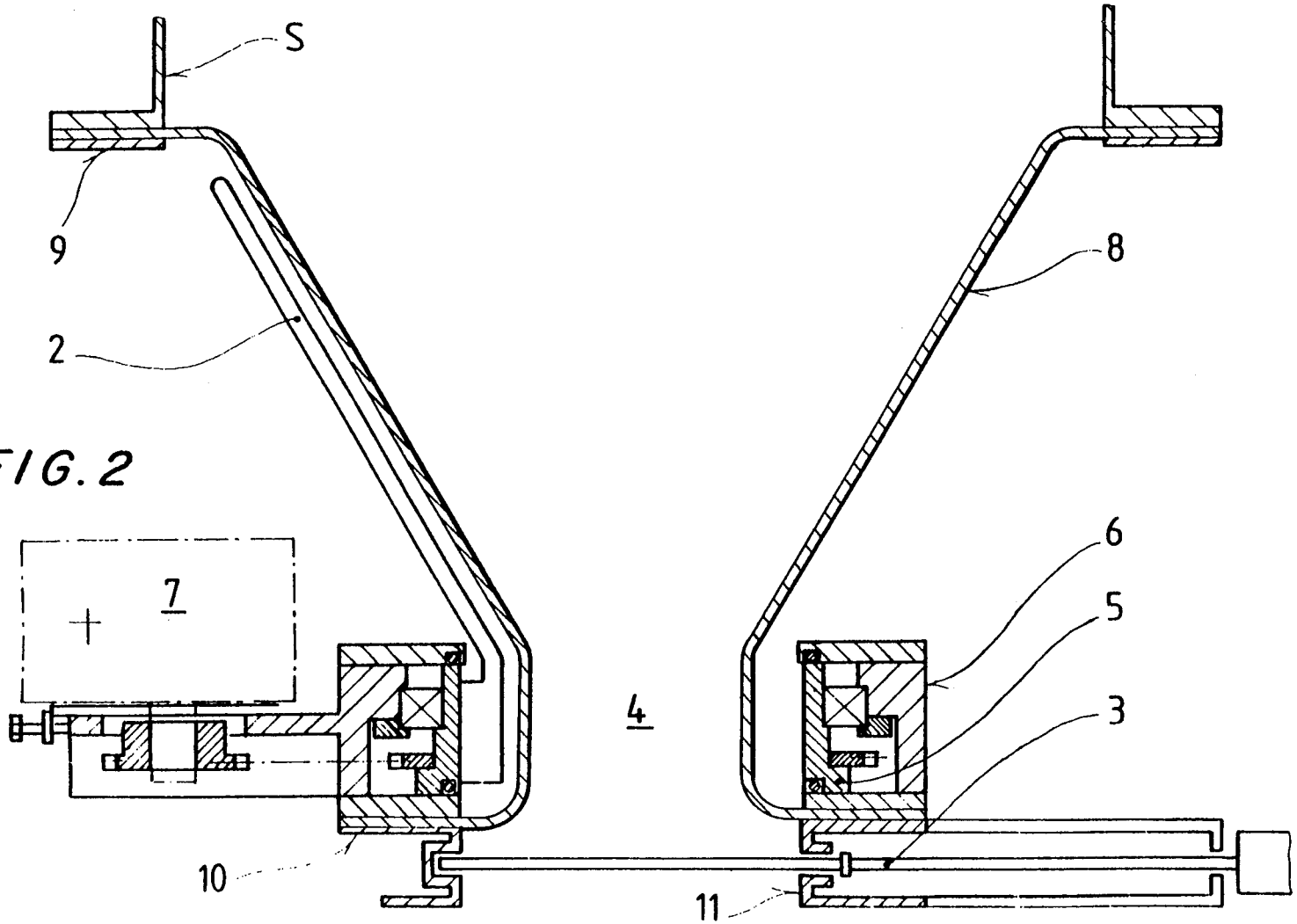
FIG. 2—a front-elevation view of another embodiment of the subject matter of the invention, in cross-sectional view as well.
Figure 4A:
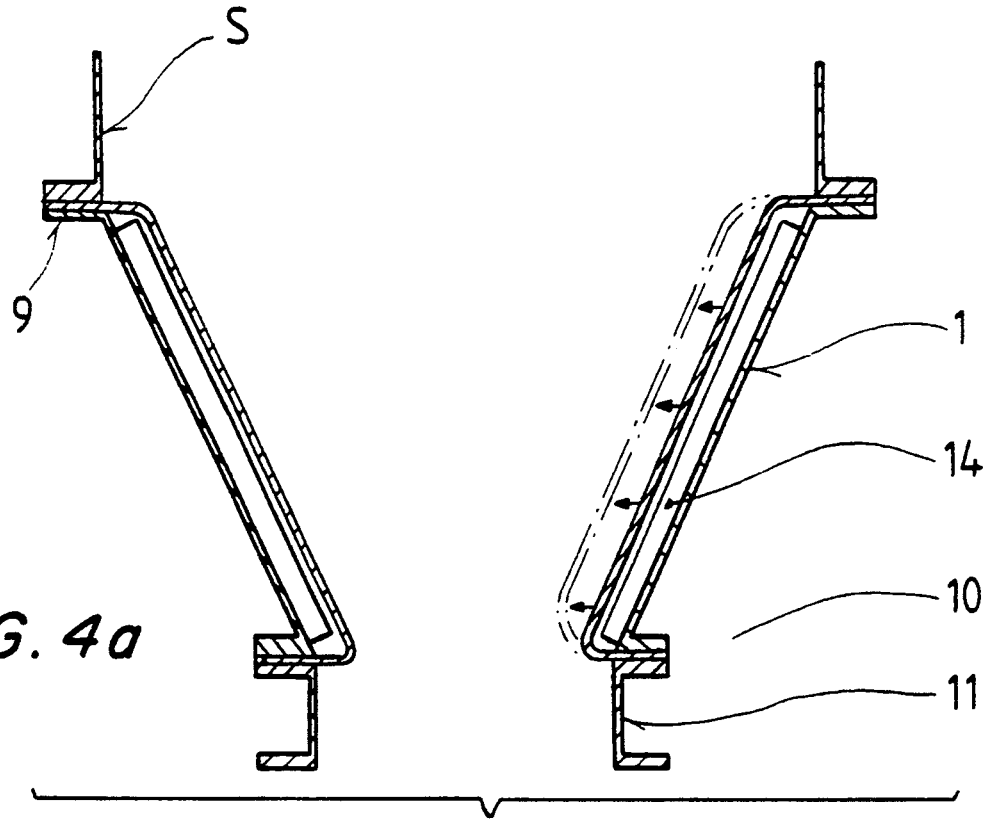
Figure 5:
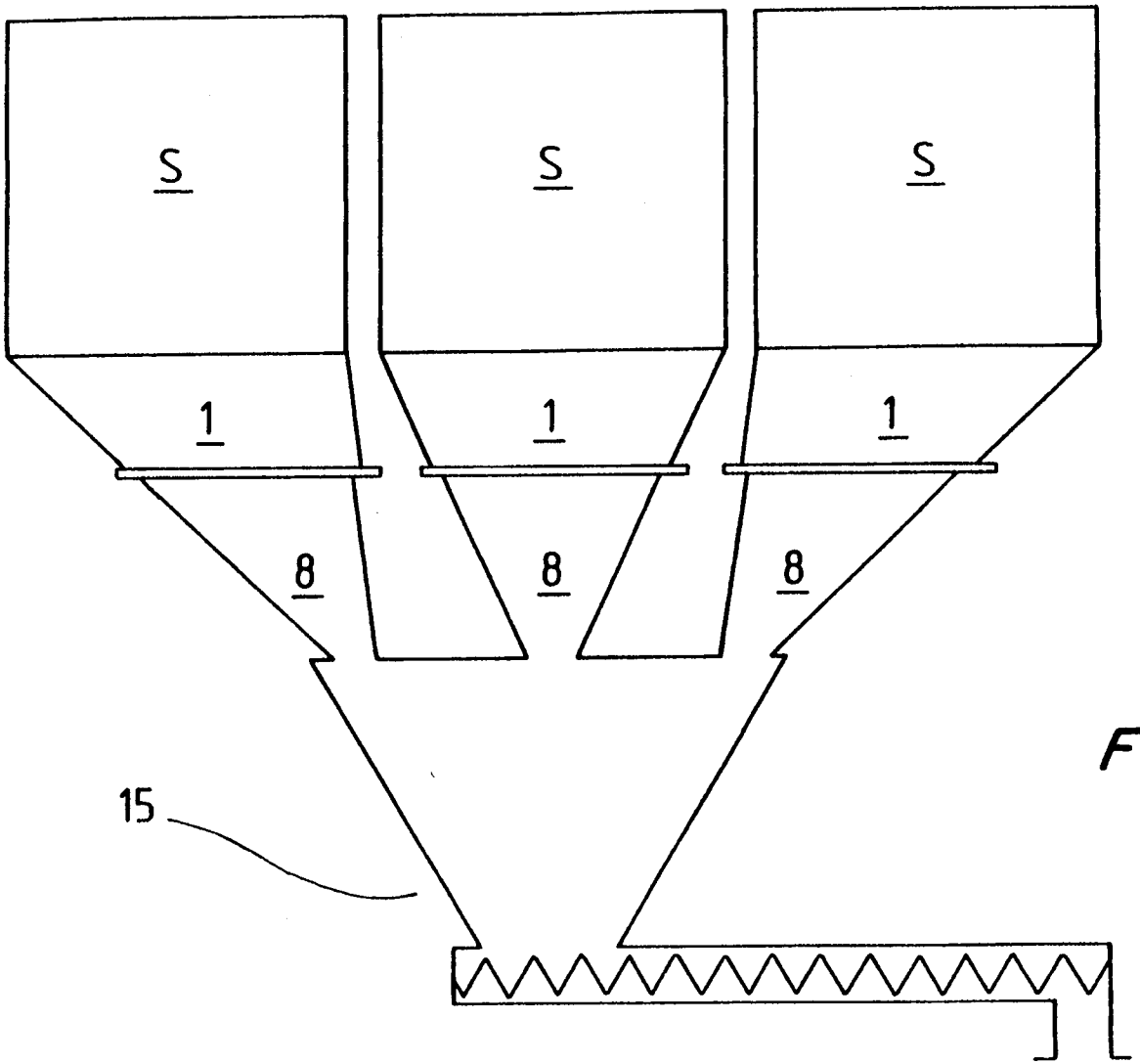
FIG. 5—a plan view of a mixing arrangement comprising three storage bins each of them provided with a discharging apparatus according to the invention and a mixing apparatus for the formation of compound materials.

According to a further embodiment of the invention it is possible to dispense with the rigidly mounted funnel 1, as shown in FIG. 2. In such a case, it is recommended to arrange a plurality of struts between the periphery of the opening of the bin bottom and the gear casing 6 outside the imaginary conical surface formed by the path of movement of the stripping unit 2 as shown in FIGS. 4*a* and 5. The struts, for instance, replace the funnel 1, or form it respectively, with openings.

Figure 3B:
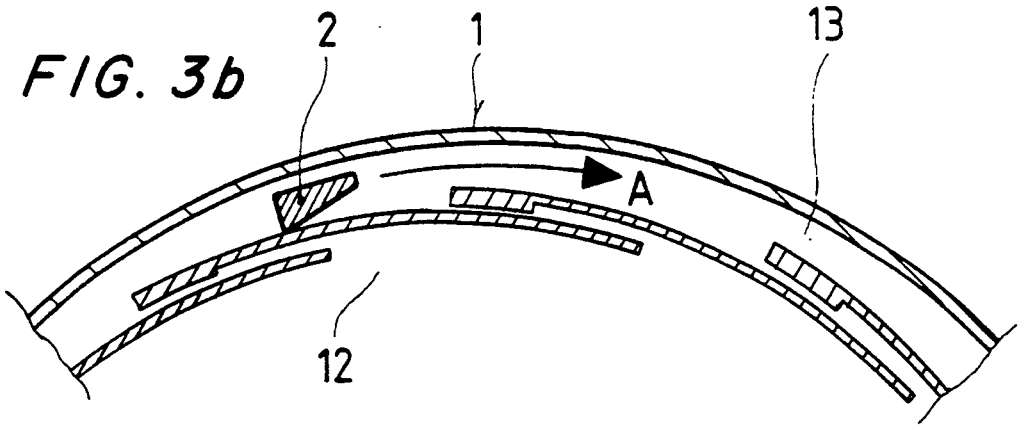
FIG. 3*b*—an enlarged partial plan view of the detail according to FIG. 3*a* on the level of the orifice of relatively large cross section of the discharging apparatus.
Figure 3A:
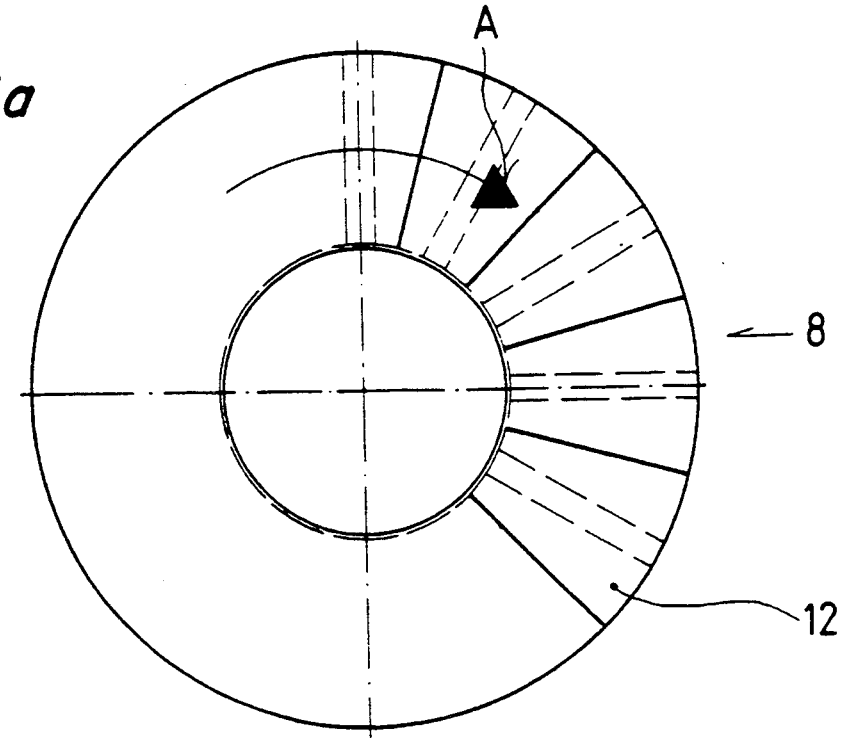
FIG. 3*a*—a complete plan view of another embodiment of an important detail of the discharging apparatus provided by the invention.

Alternatively, the funnel-shaped foil 8 may be designed in the form of flake-shaped strips of textile fabric and/or plastic material 12 overlapping each other along their edges which extend in the direction of the generatrices of the surface of the funnel. The overlapping can be oriented in each case in the direction of rotation A of the stripping unit 2 as shown by arrow A and the overlapping edges are reinforced by a reinforcing beam 13 as shown in FIGS. 3*a* and 3*b*.

Figure 4B:
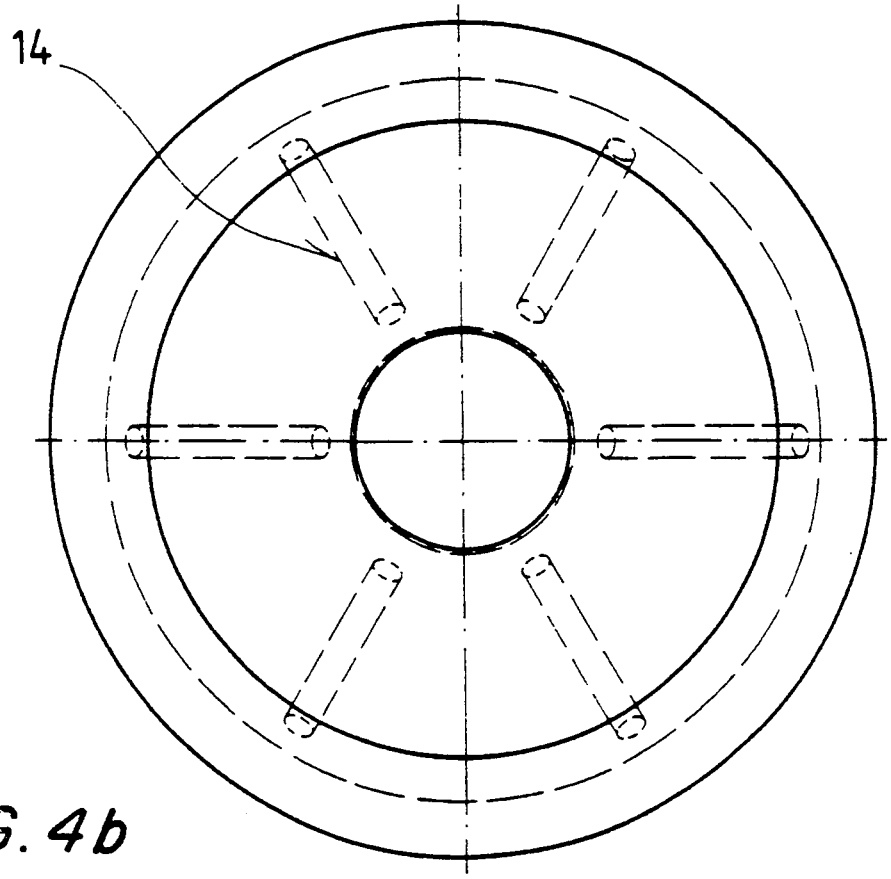
Figure 4C:
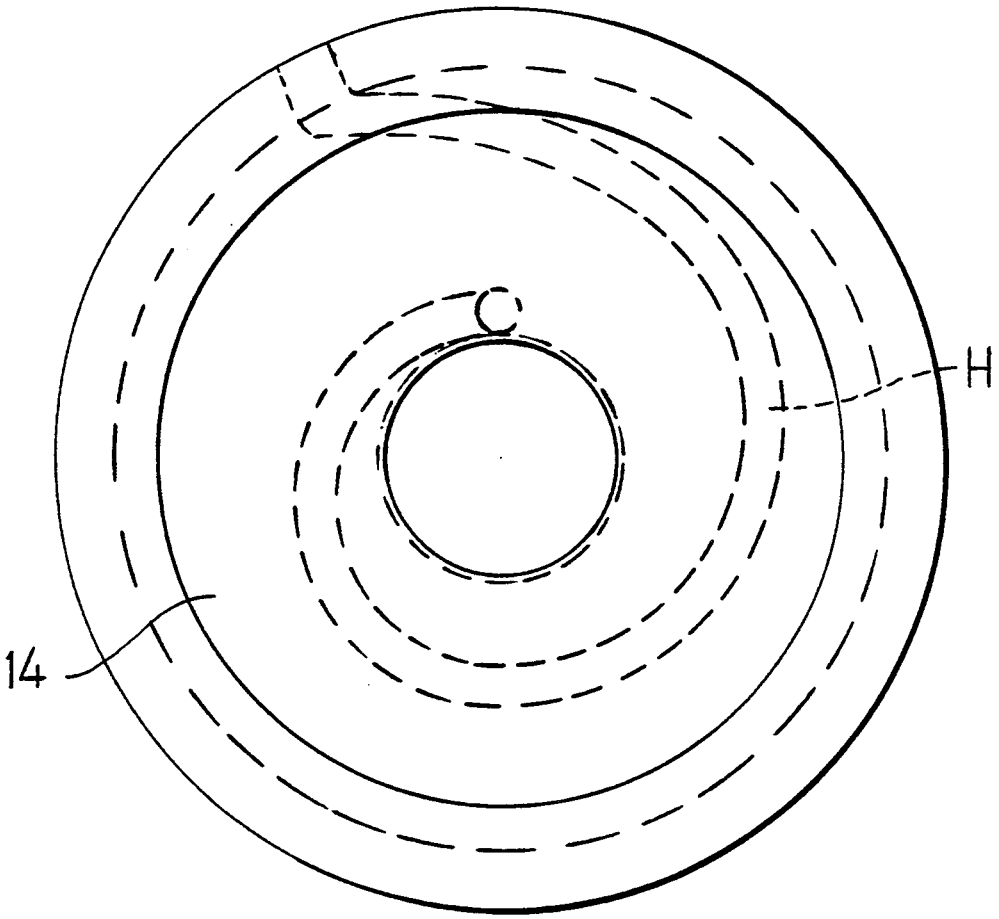
FIG. 4*c* is a plan view of another embodiment.

A still further embodiment of the invention provides—instead of rotating stripping units 2—at least one, in particular a plurality of activation bodies 14. The bodies may be formed by inflatable pads or hoses and may be biased by means of a pressure medium. They are symmetrically distributed between the inner surface of the rigidly mounted outer funnel 1 and the funnel-shaped foil 8. The activation bodies may be designed in the form of, for example, helically or spirally (cone-shaped) wound hoses, which can be activated by means of compressed-air impulses in a revolving succession as shown in FIGS. 4*a* and 4*b*. However, it would also be possible to use a hose as an activation body, with the hose H being wound in a helicoid manner around the funnel-shaped foil 8 as shown in FIG. 4*c*.

FIG. 5 illustrates a possible use of apparatuses in accordance with the invention for simultaneously discharging bulk material from three storage bins S of a so-called mixing arrangement B for the formation of a compound material made of granular components. Of course, the mixing arrangement B could also comprise a different number of storage bins. In this arrangement, the lower portion of the funnel-shaped foil 8 of each discharging apparatus, which is connected—while tapering away—to its appertaining hollow cylindrical discharge hole, is not covered by the rigidly mounted outer funnel 1. The foil portions rather form each an oblique cone with a middle axis being inclined toward a mixing apparatus 15, so that the axes of all the oblique cones interesect at the inlet of the mixing apparatus 15. Each of these foil portions having the shape of an oblique cone may be assigned a stripping unit 2 which, rotating on a circular path, acts on foil 8 merely along a certain portion of its orbit.

The foil 8 can be composed of several layers as shown in FIG. 1, which together form a compound material.

What is claimed is:

1. An apparatus for discharging dosed quantities of a bulk material from a bin having a discharge end, the apparatus comprising material loosening means adapted to extend below said discharge end; foil means covering said material loosening means and extending so as to form a conical surface for contacting directly the bulk material filled in the bin, so that said loosening means contact the bulk material indirectly through said foil means; and a shutter associated with said foil means and movable between an open position and a closed position to open and close said discharge end of the bin, said material loosening means including stripper means rotatably mounted outside said foil means and extending substantially parallel to said surface for stripping and loosening the bulk material by rotating along said surface.

2. An apparatus as defined in claim 1; and further comprising a funnel-shaped wall adapted to be attached to the discharge end of the bin and surrounding said material loosening means and foil means.

3. An apparatus as defined in claim 1, wherein said foil means is composed of a plastic material.

4. An apparatus as defined in claim 1, wherein said foil means include at least two foil layers.

5. An apparatus as defined in claim 4, wherein one of said foil layers is composed of a natural material while the other of said foil layers is composed of a plastic material.

6. An apparatus as defined in claim 4, wherein said foil layers of said foil means form a compound material.

7. An apparatus as defined in claim 1, wherein said foil means is gas permeable.

8. An apparatus as defined in claim 1; and further comprising a funnel shaped wall adapted to extend from the discharge end of the bin, said foil means extending from a top portion to a lower portion of said funnel shaped wall.

9. An apparatus as defined in claim 1; and further comprising a wall adapted to extend from the discharge end and defining a discharge orifice, said wall including struts directly attachable to the discharge end of the bin and extending in the vertical direction to the region of said discharge orifice, said struts being distributed around the material loosening means and said foil means.

10. An apparatus as defined in claim 1, wherein said foil means include overlapping flakes.

11. An apparatus as defined in claim 1, wherein said material loosening means includes an inflatable body uniformly distributed over said conical surface of said foil means outside of said conical surface.

12. An apparatus as defined in claim 11, wherein said inflatable body includes at least one hose.

13. An apparatus as defined in claim 12, wherein said hose is spirally and helically wound to assume a conical shape.

14. An apparatus as defined in claim 11, wherein said inflatable body includes at least two inflatable bodies.

15. An apparatus as defined in claim 14, wherein said inflatable body includes at least three inflatable bodies.

16. An apparatus as defined in claim 1, for discharging dosed quantities of a bulk material from a plurality of bins each having a discharge end, wherein a plurality of said material loosening means is provided each extending below the discharge end of each of the bins, a plurality of said foil means are provided so that each of said foil means covers a respective one of said material loosening means and forms a conical surface for contacting directly the bulk material while each of said loosening means contacts the bulk material indirectly through said foil means, and a plurality of said shutter means associated with respective one of said foil means and movable between an open and a closed position; and further comprising a mixing arrangement associated with all said foil means and located below said foil means for mixing the bulk material from said foil means, said foil means having axes which are inclined toward said mixing arrangement.

17. An apparatus for discharging dosed quantities of a bulk material from a bin having a discharge end, the apparatus comprising material loosening means adapted to extend below said discharge end; foil means covering said material loosening means and extending so as to form a conical surface for contacting directly the bulk material filled in the bin, so that loosening means contact the bulk material indirectly through said foil means; and a shutter associated with said foil means and movable between an open position and a closed position to open and close said discharge end of the bin, said foil means including overlapping flakes which overlap one another within a region extending along a generatrix of said conical surface.

18. An apparatus as defined in claim 17, wherein said material loosening means includes stripper means rotatably mounted outside said foil means and extending substantially parallel to said conical surface for stripping and loosening bulk material by rotating movement along said surface, said flakes overlapping each other in direction of said rotating movement.

19. An apparatus for discharging dosed quantities of a bulk material from a plurality of bins each having a discharge end; the apparatus comprising a plurality of material loosening means provided each below the discharge end of each of said bins; a plurality of foil means arranged so that each of said foil means cover a respective one of said material loosening means and forms a concial surface for contacting directly the bulk material while each of said loosening means contacts the bulk material indirectly through said foil means; and a plurality of shutter means associated with a respective one of said foil means and movable between an open position and a closed position so as to open and close the discharge end of a respective one of the bins; a mixing arrangement associated with all said foil means and located below said foil means for mixing the bulk material from said foil means, said foil means having axes which are inclined toward said mixing arrangement, each of said material loosening means including stripper means rotatably mounted outside said foil means and extending along said conical surface for stripping and loosening bulk material, at least one of said stripper means being rotatable so as to contact said foil means only during a part of the rotating movement.

20. An apparatus for discharging dosed quantities of a bulk material from a bin having a discharge end, the apparatus comprising material loosening means adapted to extend below said discharge end; foil means covering said material loosening means and extending so as to form a conical surface for contacting directly the bulk material filled in the bin, so that said loosening means contact the bulk material indirectly through said foil means; a shutter associated with said foil means and movable between an open position and a closed position to open and close said discharge end of the bin, said foil means including overlapping flakes which overlap one another within a region extending along a generatrix of said conical surface; and reinforcing beam means provided on at least a part of said flakes on an edge overlapped by adjacent ones of said flakes so as to reinforce the overlapped edges of said flakes.

* * * * *